United States Patent [19]

Graham et al.

[11] 4,441,389

[45] Apr. 10, 1984

[54] CHAIN SEVERING APPARATUS AND METHOD

[75] Inventors: George W. Graham, North Kingstown, R.I.; Richard P. McCally, Mansfield, Mass.

[73] Assignee: Avon Products Inc., New York, N.Y.

[21] Appl. No.: 290,064

[22] Filed: Aug. 4, 1981

[51] Int. Cl.[3] ..... B26D 7/06

[52] U.S. Cl. ..... 83/140; 83/685; 59/11; 59/34

[58] Field of Search ..... 59/29, 11, 7, 34, 35, 59/16, 18; 83/13, 140, 685, 686, 687, 688, 689, 690, 691

[56] References Cited

U.S. PATENT DOCUMENTS

| | | | |
|---|---|---|---|
| 655,036 | 7/1900 | Wailes | 59/11 |
| 1,901,212 | 3/1933 | Wells | 59/16 |
| 2,108,619 | 2/1938 | Smith | 83/140 |
| 3,186,284 | 6/1965 | Bennett | 83/685 |

*Primary Examiner*—Daniel C. Crane
*Assistant Examiner*—David B. Jones

[57] ABSTRACT

A practice of severing a length of chain wherein the chain is supported and an interior link of the chain is severed at the link portion which passes through the central opening of an immediately adjacent link.

10 Claims, 7 Drawing Figures

CHAIN SEVERING APPARATUS AND METHOD

BACKGROUND OF THE INVENTION

This invention pertains to jewelry manufacture and, in particular, to the manufacture of jewelry chains.

Jewelry chains typically comprise a succession of chains links, with the end links of the chain being adapted to connect to a latch for latching the chain together. Typically, the latch comprises loops connected to each end link, one loop then being provided with a latching member which can detachably connect to the other loop.

The interior chain links are typically annular in configuration with the interior of the loop annulus defining the link open area. Each interior link has first and second courses which strongly couple with the preceding and succeeding chain links, respectively. The first course extends through the open area of the preceding link from one side of that link to the other side and the second course extends through the open area of the succeeding link from one side of that link to the other side. The open area of each interior link thus contains the strongly coupled first course of the succeeding link and the strongly coupled second course of the preceding link.

In the manufacture of chains of the above type, a section of chain is pulled from a chain roll past a severing location to a stop member. The distance between the severing location and the stop member represents the desired chain length. At the severing location, a cutting edge is passed transverse to the chain links severing same.

While the above procedure results in a chain of desired length, the cut end of the chain and the cut end of the chain roll are not usually in condition for immediate processing. More particularly, the last link of the chain and the first link of the roll are strongly coupled to and, therefore, retain the second course and the first course, respectively, of a cut link. These link courses must, therefore, be removed before a latch can be attached to the chain and before the chain roll can be unrolled to provide the next chain length.

Generally, removal of the retained link courses is effected by a hand reaming operation. As can be appreciated, such a procedure is exceedingly difficult and time-consuming and significantly slows down the overall production process. This is particularly true in the production of flat chain, since with flat chain the link courses are tightly held by the respective end links.

It is therefore a broad object of the present invention to provide a method and apparatus for severing chain which is improved over prior art practices.

It is a further object of present invention to provide a method and apparatus for severing chain which is more rapid and requires less manpower than prior art practices.

SUMMARY OF THE INVENTION

In accordance with the principles of the present invention the above and other objects are realized in a practice wherein the chain to be severed is supported and the supported chain then severed at a first or second course or link portion of a chain link.

In the present practice, severing is thus effected at a course of a chain link (i.e., first or second course or link portion) which is strongly coupled to an adjacent end link. As a result, separation of the cut link from such adjacent end link occurs readily without the need of significant further processing. The chain forming procedure is, therefore, greatly simplified and an overall more rapid operation results.

In the embodiment of the invention to be disclosed hereinafter, severing occurs at a first course or link portion of a link and at a second course or link portion of the same link or a succeeding link of the supported chain section. This results in both the end link of the cut chain and the end link of the chain supply being left free of cut links. Furthermore, in this embodiment, the supported chain is engaged by means which functions to hold the chain as it is being severed.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
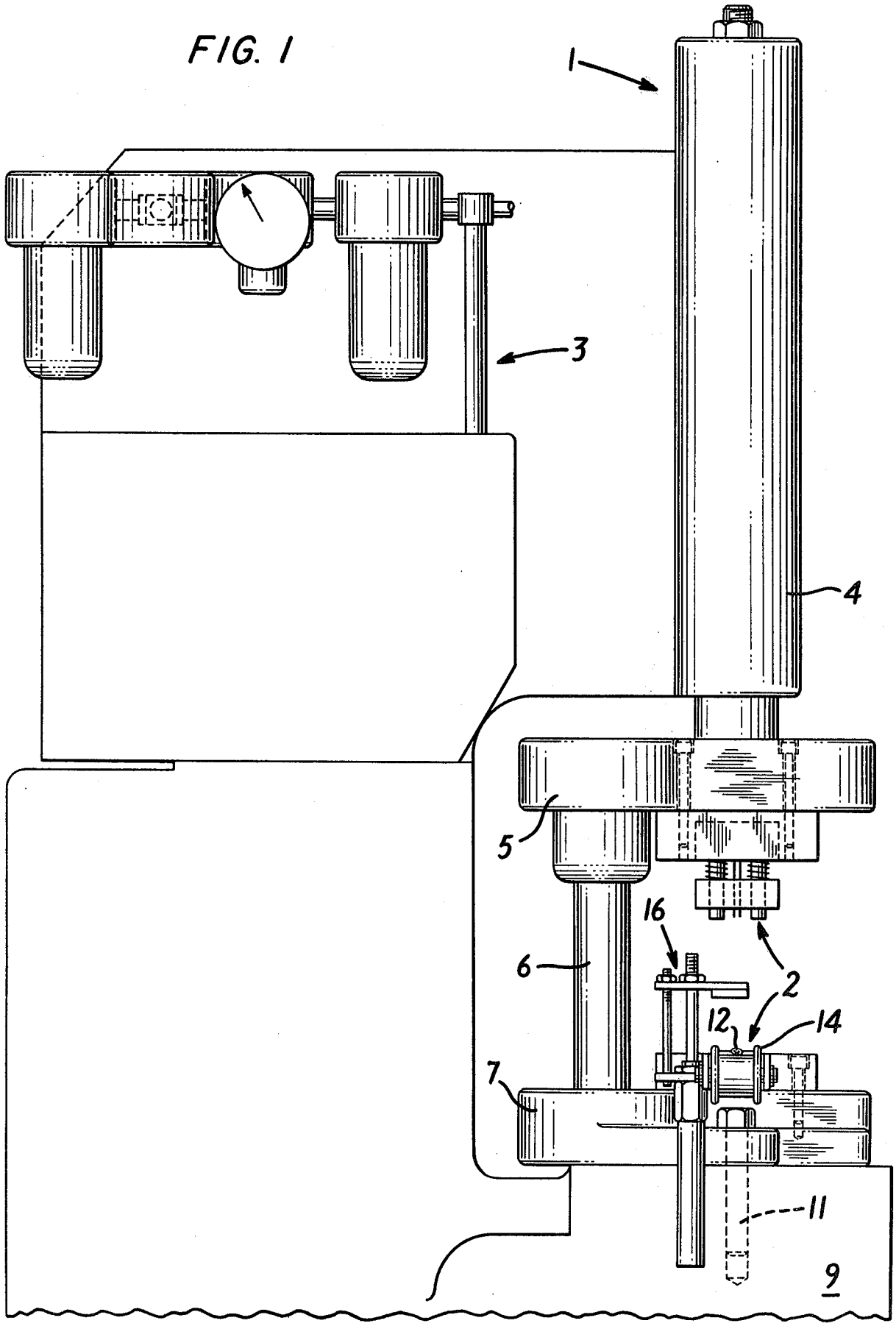
FIG. 1 illustrates a die press incorporating a chain severing apparatus in accordance with the invention.

In FIG. 1, a conventional pneumatic press 1 incorporates a chain servering apparatus 2 in accordance with the present invention. The press 1 includes a pneumatic supply system 3 which operates a ram 4 to which is mounted an upper platen 5. The platen 5 is slidably mounted on a guide 6 which extends between the upper platen and a lower platen 7. The lower platen is mounted to the press frame 9 via threaded screw 11.

Figure 2:
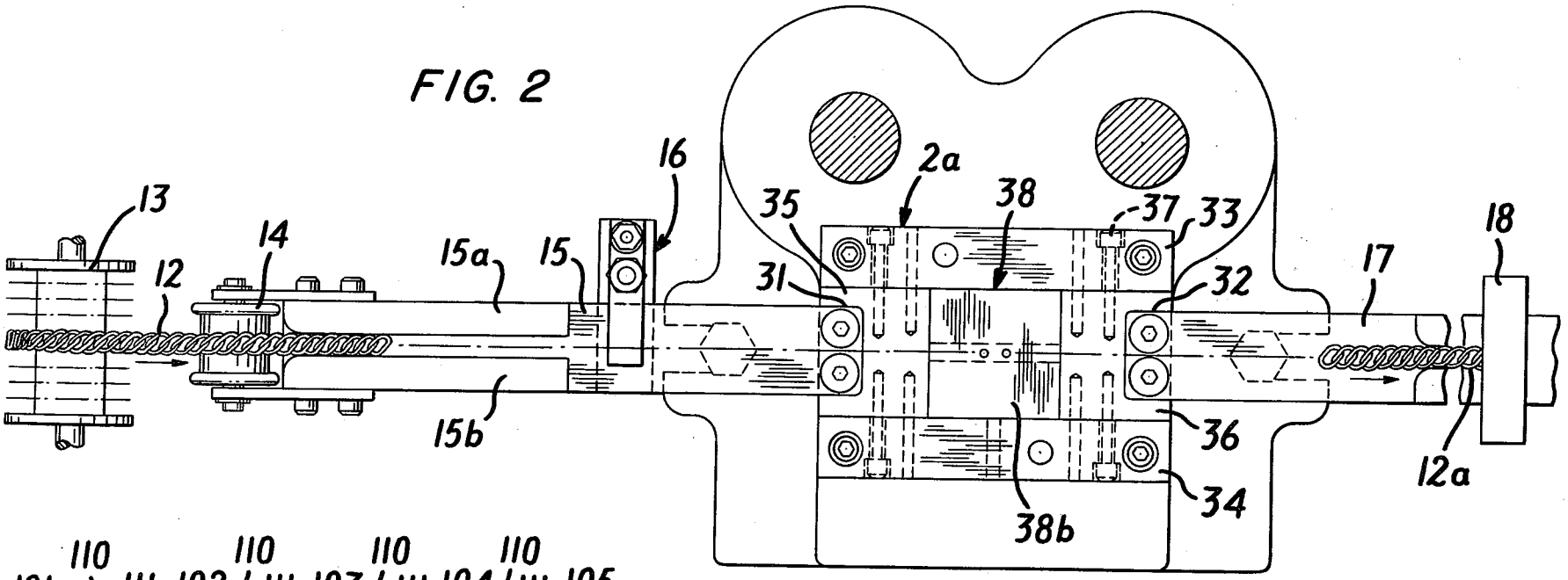
FIG. 2 shows a plan view of the lower section of the press of FIG. 1.

Chain 12 to be severed into specified lengths is conveyed from a chain roll 13 (see, FIG. 2) over a front guide roller 14 forward of the press 1 onto a chain entry track 15 having laterally spaced guide members **15*a* and 15*b*. A clamp assembly 16 follows the guide members 15*a* and 15*b*. Forward of the assembly 16 the track 15 seats in a recess 31 at the front end of the bottom section 2*a* of the severing apparatus 2. A chain exit track 17 extends outwardly of a second recess 32 at the back end of the section 2*a*. Along the track 17 a stop member 18** is slidably mounted to permit adjustment of the length of chain to be severed.

Figure 3:
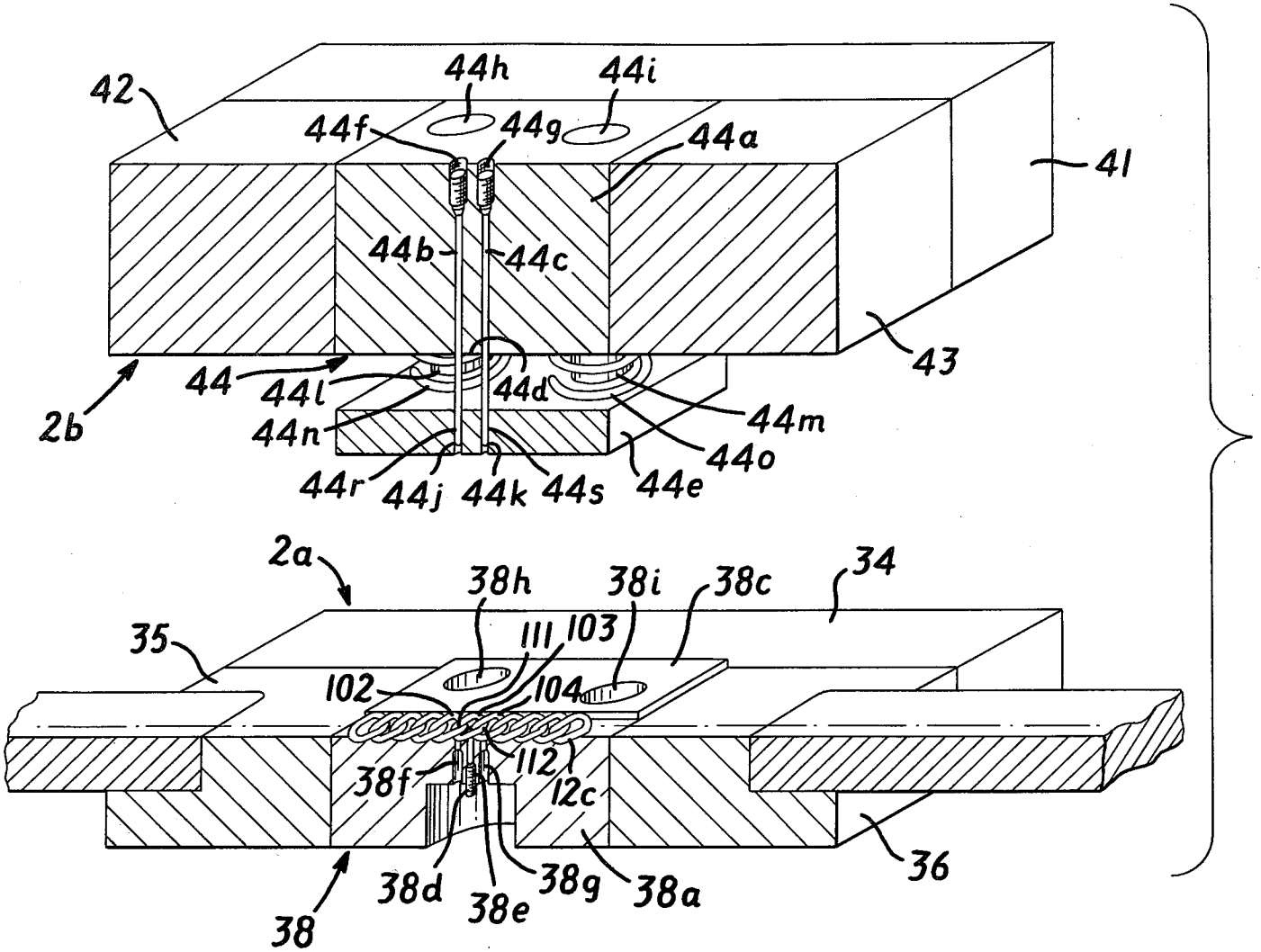
FIG. 3 illustrates the chain severing apparatus of the invention in greater detail.

The severing apparatus 2 of the invention is shown in greater detail in FIG. 3. The apparatus comprises a lower section **2*a* having front and rear support members 33 and 34 and opposing side support members 35 and 36. These members when bolted together via screws 37 support a lower removable severing assembly 38. The assembly 38 comprises a block or plate 38*a* which supports front and rear guide plates 38*b* and 38*c* for guiding the central section 12*c* of the chain length supported on the severing section 2*a*. A locating pin 38*d* depends upwardly from the block slightly above the block surface and is supported in a first bore 38*e*. Two further bores 38*f* and 38*g* are situated immediately adjacent to and on opposite sides of the pin 38***d*. Slots 38*h* and 38pass through the plate 38*c* and into the block 38*a*. The function of the pin 38*d*, the bores 38*f* and 38*g* and the slots 38*h* and 38*i* will become apparent from the discussion below.

The upper section 2*b* of the severing apparatus also comprises front (not visible) and rear plates 39 and 41 and opposing side plates 42 and 43 which when bolted support an upper removable severing assembly 44. Assembly 44 includes a block 44*a* having bores 44*f* and 44*g* on opposite sides of a block position 44*d* which aligns with the bore and pin 38*e* and 38*d*. The bores 44*f* and 44*g* support slender severing rods 44*b* and 44*c* having severing edges 44*j* and 44*k* which extend outward of the block 44*a*.

Cylindrical rods 44*l* and 44*m* depend outwardly from slots 44*h* and 44*i* in block 44*a*, the former rods and slots being in alignment with the mating slots 38*h* and 38*i* of the block 38*a*. A plate 44*e* is resiliently supported by springs 44*n* and 44*o* which are arranged in encircling relationship with rods 44*l* and 44*m*, respectively. These rods pass through passages (not visible) 44*p* and 44*q* in plate 44*e* and extend slightly below the plate bottom. Severing rods 44*b* and 44*c* likewise extend into passages 44*r* and 44*s* of the plate 44*e*, these rods being slightly above the plate bottom.

Figure 4:
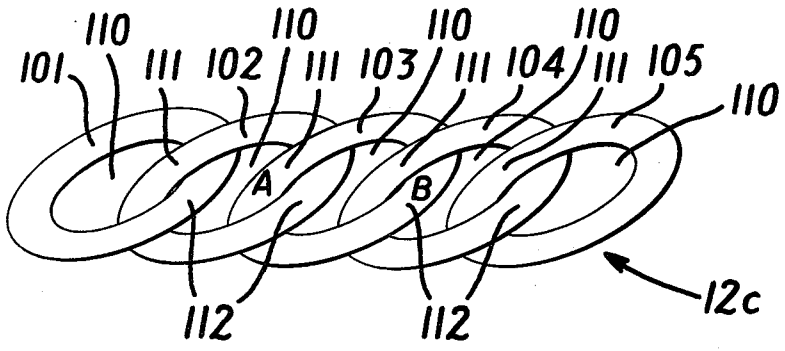
FIG. 4 illustrates an exploded view of a section of chain.

FIG. 4 shows in exploded fashion a number of links 101–105 of the chain section 12*c*. As can be seen, each link is of annular configuration having an open area 110 defined by the inner annular surface of the link. Each link includes a first course or link portion 111 which strongly couples with the preceding link and a second course or link portion 112 which strongly couples with the succeeding link. Each first course or link portion 111, moreover, extends through the open area 110 of the respective preceding link from the front to the rear side of that link, while each second course or link portion 112 extends through the open area 110 of the succeeding link from the front to the rear side of that link. The open area 110 of each link is thus occupied by first and second courses of the succeeding and preceding links.

In accordance with the present invention, it has been recognized that severing of the chain section 12*c* to provide end links for the resultant chain and for the chain roll which are free of cut links can be realized by severing a link of the section 12*c* at its first course or link portion 111 (e.g., link 103 at A) and by severing the same link or a suceeding link at its second course or link portion (e.g., the link 103 at B). This is so because the strongest coupling between links and link retention occurs at these link courses.

Accordingly, the positioning of the severing surfaces 44*j* and 44*k* in block 44*a* is such that the surface 44*j* is aligned with the first course of a link of the section 12*c* and the surface 44*k* with a second course of the same or a succeeding link of such section. In the present illustrative case, the surfaces are aligned with the first and second courses of the same link, i.e., link 103, as above described. In general, however, whether the surface 44*k* aligns with the second course of the same or succeeding link will depend upon the particular characteristics (thickness, etc.) of the chain being cut. If a succeeding link is to be cut, it is preferable that it be as close as possible to the first cut link, since this will minimize discarded chain (i.e., chain between the first and second cut links).

The above-discussed positioning of the severing surfaces 44*g* and 44*k*, is obtained in the embodiment of FIG. 3 by situating the slots 38*f* and 38*g* at preselected distances relative to the pin 38*d*. In particular, such preselected distances are such that with the pin 38*d* seated in the recess between first and second courses occupying the open area 110 of a link (i.e., the link 103 in the present case), the slots 38*f* and 38*g* align, respectively, with the first course of a link adjacent the pin (i.e., the link 103 in the present case) and with the second course of that link or a succeeding link. Situating slots 38*f* and 38*g* at such preselected positions, in turn, situates the corresponding slots 44*f* and 44*g* and, therefore, the severing surfaces 44*j* and 44*k* thereat.

Figure 5:
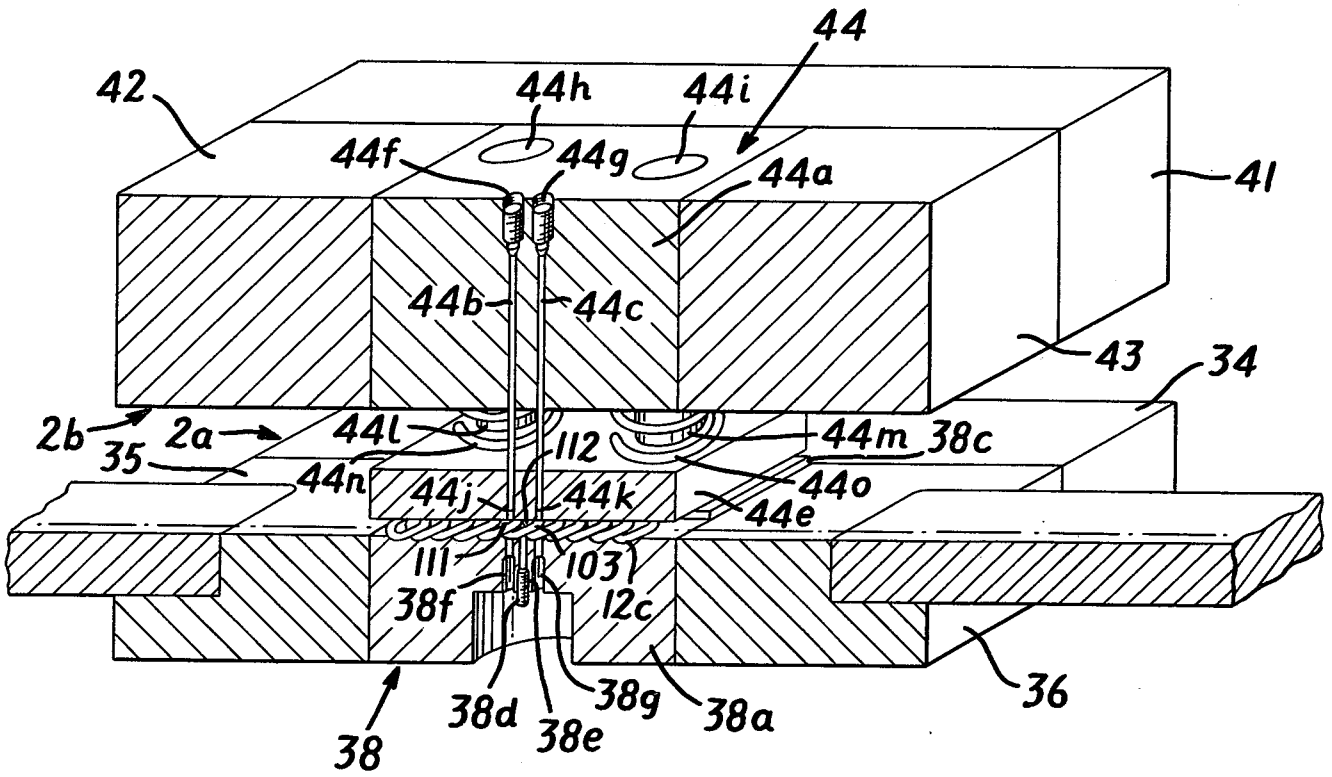
FIGS. 5 and 6 show the severing apparatus in its operating sequence of first engaging the chain and then servering same.
Figure 6:
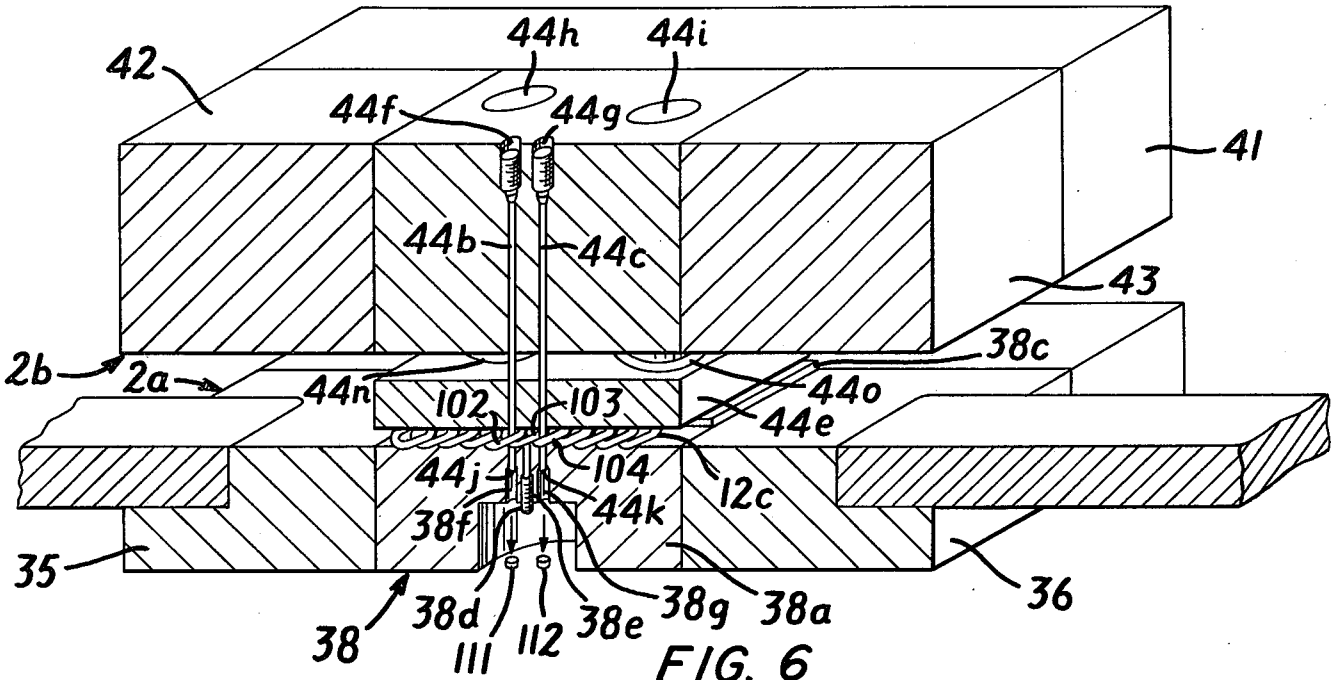
Figure 7:
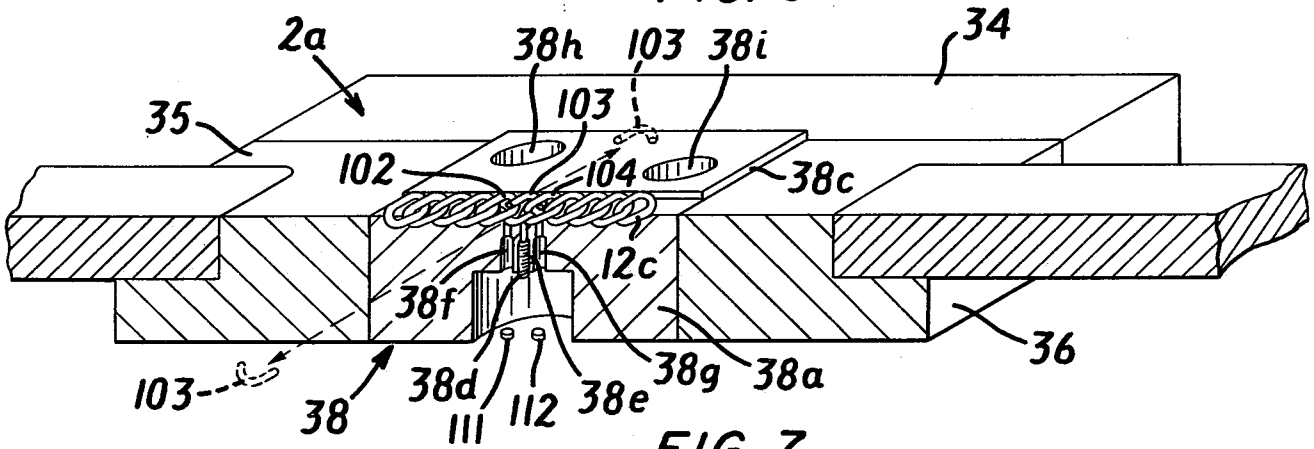
FIG. 7 illustrates the bottom section of the severing apparatus showing the severed chain link.

Operation of the severing apparatus 2 is illustrated by FIGS. 5–7. More particularly, the free end of the chain 12 is first pulled from the roll 13 over the track 15, past the severing apparatus 2 and over the track 17 to the stop 18. This places the chain section 12*c* on the block 38*a*. The chain is then moved slightly back and forth until the pin 38*d* seats in the recess between the first and second link courses. This aligns the severing surfaces 44*j* and 44*k* as above-described.

The ram 4 then moves the upper platen and, therewith, the upper section 2*a* downward towards the section 2*b*. This downward movement brings the rods 441*l* and 44*m* into the slots 38*h* and 38*i*, thereby ensuring correct alignment of the severing surfaces 44*j* and 44*k* and their supported rods with the slots 38*f* and 38*g*.

The plate 44*e* then engages the plates 38*b* and 38*c* and the chain section 12*c*. The plate is thereupon urged upward against the springs 44*n* and 44*o* and forcefully holds the chain. The rods 44*b* and 44*c* thereafter pass out of the plate slots and engage, in the present case, the first and second courses of 111 and 112 of link 103 with sufficient force to sever these link courses. The rods then continue downward pushing the severed link courses 111 and 112 into the bores 38*f* and 38*g*, which are then also entered by the rods.

Movement of the ram 4 in the reverse direction brings the upper section 2*a* back to its initial position. The chain section 12*c* remains on the lower section 2*b* with the remaining pieces of link 103 now being freely removable from the preceeding and succeeding chain lengths 102 and 104. The latter link now forms the last link of the cut chain and has an open area previously occupied by the second course 112 of the severed link 103. This open area enables direct receipt by the chain of a ring of a latching assembly. Moreover, the link 102 now serves as the first link of the chain roll. As a result, the roll can now be immediately used to cut the next chain length, since the link 102 is free of the cut link and also has an open area previously occupied by the first course 111 of the severed link 103 for receipt of a ring of a latching assembly.

As can be appreciated, the present severing apparatus provides a rapid and relatively simple mechanism for severing chains to desired chain lengths, while at the same time providing terminal links for the chain lengths suitable for immediate attachment of latching rings. Costly and lengthy manual reaming procedures are, therefore, avoided resulting in a considerable overall savings.

In all cases, it is understood that the abovedescribed arrangements are merely illustrative of the many possible specific embodiments which represent applications of the present invention. Numerous and varied other arrangements can readily be devised in accordance with the principles of the present invention without departing from the spirit and scope of the invention.

What we claim is:

1. Apparatus for severing a length of chain, said chain comprising a succcession of interior annular links between first and second end links, each interior link passing from one side of the immediately preceding link to the other side of the immediately preceding link and having a first link portion passing through the central opening defined by that immediately preceding link and each interior linking passing from one side of the immediately succeeding link to the other side of the immediately succeeding link and having a second link portion passing through the central opening defined by that immediately succeeding link, said apparatus comprising:

means for supporting said chain, said support means including: a first member for supporting a section of said chain including said interior links; a pin depending outwardly from said first member and adapted to seat in the recess between first and second link portions, respectively, of succeeding and preceding interior links passing through the same central opening of an interior link of said chain section; and said first member having first and second bores disposed at preselected first and second distances, respectively, relative to said pin, said first and second distances being such that with said pin seated in said recess said first bore aligns with a first link portion of an interior link and said second bore aligns with a second link portion of an interior link;

and means for severing the link portion aligned with said first bore and the link portion aligned with sad second bore, said severing means including: a second member for moving relative to said first member between first and second positions; means affixed to said second member for engaging said chain section as said second member moves from said first to second positions; and first and second severing members carried by said second member and positioned to sever the link portion aligned with said first bore and the link portion aligned with said second bore, respectively, as said second member moves from said first to said second positions.

2. Apparatus in accordance with claim 1 wherein:

said second member has third and fourth bores aligned with said first and second bores, respectively, said third and fourth bores carrying sad first and second severing members with the first and second ends of said, first and second members extending outward of said second member.

3. Apparatus in accordance with claim 1 wherein:

said first and second bores are on opposite sides of said pin.

4. Apparatus in accordance with claim 1 wherein:

the first link portion of an interior link and the second link portion of an interior link pass into said first and second bores after being severed by said first and second severing members;

and the first and second ends of said first and second severing members enter said first and second bores during movement of said second member from said first to said second positions.

5. Apparatus in accordance with claim 1 wherein:

said chain engaging means includes:

a third member disposed between said first and second members;

and means for resiliently attaching said third member to said second member;

said third member having first and second through passages aligned with said third and fourth bores and into which said first and second ends of said first and second severing members extend in the first position of said second member;

said third member engaging said chain section during movement of said second member from said first to second positions, whereby said resilient means is compressed causing said first and second ends to extend outwardly of said third member for severing of the first link portion of an interior link and the second link portion of an interior link, respectively.

6. Apparatus in accordance with claim 5 further comprising:

alignment means for aligning said first and second bores and said third and fourth bores, respectively.

7. Apparatus in accordance with claim 6 wherein:

said alignment means includes:

a first alignment slot in said first member;

and a first alignment rod carried by said second member and extending outward of said second member beyond said first and second ends of said first and second severing members, said first alignment rod having a configuration to mate with said first alignment slot.

8. Apparatus in accordance with claim 7 wherein:

said alignment means further includes:

a second alignment slot different from said first alignment slot in said second member;

and a second alignment rod carried by said second member and extending outward of said second member beyond said first and second ends of said first and second severing members, said second alignment rod having a configuration to mate with said second alignment bore.

9. Apparatus in accordance with claim 8 wherein:

said third member has third and fourth through passages through which said first and second alignment rods extend.

10. Apparatus in accordance with claim 9 wherein:

said resilient means includes first and second springs arranged in surrounding relationship to said first and second alignment rods, respectively.

* * * * *

UNITED STATES PATENT AND TRADEMARK OFFICE

CERTIFICATE OF CORRECTION

PATENT NO. : 4,441,389

DATED : April 10, 1984

INVENTOR(S) : George W. Graham and Richard P. McCally

It is certified that error appears in the above-identified patent and that said Letters Patent is hereby corrected as shown below:

Column 3, line 2, "38pass" should read --38i pass--.

Signed and Sealed this

*Nineteenth* Day of *March 1985*

[SEAL]

*Attest:*

DONALD J. QUIGG

*Attesting Officer* *Acting Commissioner of Patents and Trademarks*